US009334684B2

(12) United States Patent
Nam

(10) Patent No.: US 9,334,684 B2
(45) Date of Patent: May 10, 2016

(54) SLIDING DOOR DEVICE FOR VEHICLE

(71) Applicant: Hyundai Motor Company, Seoul (KR)

(72) Inventor: Kyunghyun Nam, Jeollabuk-do (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 65 days.

(21) Appl. No.: 14/084,146

(22) Filed: Nov. 19, 2013

(65) Prior Publication Data

US 2014/0157670 A1 Jun. 12, 2014

(30) Foreign Application Priority Data

Dec. 10, 2012 (KR) ..... 10-2012-0143085

(51) Int. Cl.
*E05F 15/02* (2006.01)
*E05F 15/48* (2015.01)
*E05F 15/40* (2015.01)

(52) U.S. Cl.
CPC ..... *E05F 15/48* (2015.01); *E05F 15/40* (2015.01); *E05Y 2900/51* (2013.01); *E05Y 2900/531* (2013.01)

(58) Field of Classification Search
CPC ..... E05F 15/40; E05F 15/42; E05F 15/44; E05F 15/47; E05F 15/48; E05F 2015/487
USPC ..... 600/61.43; 200/61.43
See application file for complete search history.

(56) References Cited

U.S. PATENT DOCUMENTS 3,330,923 A * 7/1967 Brockmeyer et al. ..... 200/61.43
4,045,631 A * 8/1977 Dann ..... 200/61.43
4,152,870 A * 5/1979 Knap ..... 49/118
4,301,621 A * 11/1981 Houweling ..... 49/27
4,304,071 A * 12/1981 Obrecht ..... 49/26
4,340,825 A * 7/1982 Carter et al. ..... 307/116
4,698,967 A * 10/1987 Longora ..... 60/325
5,433,031 A * 7/1995 Dailey ..... 49/27
5,456,504 A * 10/1995 Brillant ..... 292/63
7,000,352 B2 * 2/2006 Ishihara et al. ..... 49/28
8,752,332 B2 * 6/2014 Thiele et al. ..... 49/27
8,854,061 B2 * 10/2014 Suhara et al. ..... 324/679
8,898,956 B2 * 12/2014 Nam ..... 49/27

(Continued)

FOREIGN PATENT DOCUMENTS

JP 2008-303577 A 12/2008
JP WO2012049733 A1 * 4/2012 ..... B60K 1/04

OTHER PUBLICATIONS

WO2012049733A1 translation.*

*Primary Examiner* — Katherine Mitchell
*Assistant Examiner* — Scott Denion
(74) *Attorney, Agent, or Firm* — McDermott Will & Emery LLP

(57) ABSTRACT

A sliding door device for a vehicle is disclosed. The sliding door device for a vehicle includes a sliding door installed in a vehicle body to be slidingly moved to open and close a door opening formed in the vehicle body. A vehicle body weather strip is attached to the door opening. A sensing device is installed in the vehicle body weather strip to sense that an object or an occupant is jammed in a state where the sliding door is closed. An electronic control unit (ECU) for receives a sensing signal of the sensing device to control opening and closing of the sliding door. Therefore, it is possible to effectively prevent an object or an occupant from being jammed in a process of closing the sliding door.

11 Claims, 6 Drawing Sheets

(56) References Cited

U.S. PATENT DOCUMENTS

2002/0113602 A1* 8/2002 Ishihara et al. ..... 324/658
2004/0070316 A1* 4/2004 Neubauer et al. ..... 310/800
2006/0021815 A1* 2/2006 Ohtaka ..... 180/274
2009/0000059 A1* 1/2009 Nakaura et al. ..... 16/82
2012/0267914 A1* 10/2012 Thiele et al. ..... 296/146.9
2013/0326955 A1* 12/2013 Kotama et al. ..... 49/13
2014/0157671 A1* 6/2014 Nam ..... 49/31

* cited by examiner

SLIDING DOOR DEVICE FOR VEHICLE

CROSS-REFERENCE TO RELATED APPLICATION

This application claims priority to and the benefit of Korean Patent Application No. 10-2012-0143085 filed in the Korean Intellectual Property Office on Dec. 10, 2012, the entire contents of which are incorporated herein by reference.

TECHNICAL FIELD

The present disclosure relates to a sliding door device for a vehicle. More particularly, the present disclosure relates to a sliding door device for a vehicle capable of preventing an object or an occupant from being jammed in a sliding door in a process of closing the sliding door.

BACKGROUND

In general, a sliding door device is applied to a large commercial vehicle such as a bus so that a large number of occupants may easily get on and off.

The sliding door device includes a sliding door installed to move along a guide rail provided in a vehicle body to open and close a door opening formed in the vehicle body, a pneumatic cylinder as a power source for moving the sliding door, a micro switch for sensing the closing of the sliding door, and a controller for controlling the pneumatic cylinder based on a sensing signal of the micro switch to control the opening and closing of the sliding door.

In addition, the sliding door device realizes a sliding door safely closing function for preventing an object from being damaged or an occupant from being injured when the object or the occupant is jammed in a space between the sliding door and the door opening in a process of closing the sliding door where the sliding door blocks the door opening.

That is, in the sliding door safely closing function, when the object or the occupant is jammed in the space between the sliding door and the door opening in the process of closing the sliding door, the sliding door is moved in a reverse direction, that is, in a direction where the door opening is opened so that it is possible to prevent the object or the occupant from being jammed.

In a method of sensing that the object or the occupant is jammed, a change in internal pressure of a weather strip attached to the sliding door to release shock and to maintain air-tightness is used. That is, when the object or the occupant is jammed, pressure is applied to the weather strip so that a change in pressure is generated. The change in the internal pressure of the weather strip is sensed to determine whether the object or the occupant is jammed.

According to the above-described conventional sliding door device, in order to prevent a malfunction from being caused by compression of the weather strip when the sliding door is closed, in a predetermined range immediately before the sliding door is completely closed, for example, in a range of 30 mm immediately before the sliding door is completely closed, although an object, such as clothes, or a shoulder strap of an occupant, or a part of the occupant's body, is jammed in the sliding door, the device ignores the jammed object or occupant is jammed and the sliding door continues closing so that the object may be damaged or the occupant may be injured.

On an incline, the sliding door may be closed by self-loading before the micro switch senses the closing of the sliding door so that an erroneous sensing may be generated in which the micro switch may not correctly sense the closing of the sliding door. In order to prevent erroneous sensing from being generated, a point in time when the closing of the sliding door is recognized by the micro switch is set to be earlier than a point in time when the closing of the sliding door is completed at a predetermined interval, for example, 30 mm.

Therefore, in a range of 30 mm immediately before the sliding door is completely closed, although the object, such as the clothes or the shoulder strap of the occupant or a part of the occupant's body, is jammed in the sliding door, the jammed object or occupant is ignored and the closing of the sliding door continues so that the object may be damaged or the occupant may be injured.

In addition, in a method of sensing that the object or the occupant is jammed, because the internal pressure of the weather strip is changed in accordance with a change in peripheral temperature of the weather strip so that a malfunction may be caused, it is determined that the object or the occupant is jammed only when pressure of no less than a predetermined pressure, for example, pressure of no less than 4.5±0.5 kgf is sensed in the weather strip.

Therefore, when an object or a part of an occupant's body of no more than, for example, 30×60 mm is jammed, it is not sensed that the object or the occupant is jammed and the closing of the sliding door continues so that the object may be damaged or the occupant may be injured and the vehicle can be driven in a state where the occupant is jammed in the sliding door so that a casualty may occur.

The above information disclosed in this Background section is only for enhancement of understanding of the background of the disclosure and therefore it may contain information that does not form the prior art that is already known in this country to a person of ordinary skill in the art.

SUMMARY

An exemplary embodiment of the present disclosure provides a sliding door device for a vehicle in which a sliding door is opened again when an object or an occupant is jammed in a space between the sliding door and a door opening of a vehicle body in a process of closing the sliding door so that it is possible to prevent a safety accident from occurring.

A sliding door device for a vehicle according to an exemplary embodiment of the present disclosure may include a sliding door installed in a vehicle body to be slidingly moved to open and close a door opening formed in the vehicle body. A vehicle body weather strip is attached to the door opening. A sensing device is installed in the vehicle body weather strip to sense that an object or an occupant is jammed in a state where the sliding door is closed. An electronic control unit (ECU) receives a sensing signal of the sensing device to control opening and closing of the sliding door.

The sensing device may include a door opening and closing sensor for sensing opening and closing of the sliding door and a jam sensor for sensing that the object or the occupant is jammed in a state where the sliding door is closed.

The sliding door may include a door weather strip attached to the vehicle body weather strip to seal the door opening. The door opening and closing sensor may include an elastic contact protrusion pressed by the door weather strip in a state where the sliding door is closed and restored to an original shape when the elastic contact protrusion is separated from the sliding door. A sensing rod is integrated with the elastic contact protrusion and is elongated and contracted in line with elongation and contraction of the elastic contact protrusion. An opening and closing sensing terminal is fixedly mounted at one leading end of the sensing rod and is connected to the ECU. A spring is inserted into an external circumference of the sensing rod to elastically support the sensing rod.

The elastic contact protrusion may be mounted in a mounting bracket to be supported. A narrow part pressing the elastic contact protrusion or separated from the elastic contact protrusion may be formed in an upper end of the door weather strip cut inward in a thickness direction.

A guide bracket may be fixedly attached to the mounting bracket in a direction of a right angle. A through hole may be formed in the guide bracket so that the sensing rod may be inserted into the through hole to be guided and moved.

The jam sensor may include a protruding fixing pin installed in the mounting bracket and ground connected to a vehicle body, a ground bracket, wherein the fixing pin is inserted into one side of the ground bracket, a sensing wire that may be elongated and has one end movably inserted into the other side of the ground bracket and the other end extendedly fixed in a longitudinal direction of the vehicle body weather strip, a jam sensing terminal installed at one end of the sensing wire and connected to or separated from the ground bracket and connected to the ECU, and a spring for elastically supporting the sensing wire.

The sensing wire may be insterted into a U-shaped supporting bracket in a longitudinal direction and fixedly mounted in the vehicle body. A stopper may be provided at one end of the sensing wire. The spring may be installed between the stopper and the supporting bracket. The sensing wire may be inserted to penetrate both side surfaces of the U-shaped supporting bracket that face each other.

The other end of the ground bracket may be arranged between one end of the sensing wire and the stopper.

The other end of the sensing wire may be a U-shaped curve and fixed by a clip. A hook may be hooked at the other end of the sensing wire. The hook may be fixed to the vehicle body by the medium of a fixing bolt.

An accommodating groove having a bottom surface grooved in a thickness direction may be extendedly formed in the vehicle body weather strip in a longitudinal direction. The sensing wire may be accommodated in the accommodating groove and separated from the bottom surface.

A pressure switch for sensing internal pressure of the door weather strip may be connected to the door weather strip through a pneumatic line. The ECU may sense a change in the internal pressure of the door weather strip through the pressure switch and may control the sliding door to be opened when the internal pressure is no less than predetermined pressure.

The sliding door device for a vehicle may further include a pneumatic cylinder as a power source for moving the sliding door and an operation line for connecting the pneumatic cylinder and the sliding door to each other so that an operating force of the pneumatic cylinder is transmitted to the sliding door.

In the sliding door device for a vehicle according to the exemplary embodiment of the present disclosure, it is possible to effectively prevent the object or the occupant from being jammed in the sliding door in the process of closing the sliding door.

Although an object with a small width and thickness or a part of an occupant's body is jammed in the sliding door, it is correctly sensed that the object or the occupant is jammed in the sliding door and the sliding door is opened. Therefore, it is possible to prevent the object from being damaged and the occupant from being injured by the sliding door in the process of closing the sliding door.

Sensing ability of sensing that the object or the occupant is jammed in the sliding door is improved so that operability and commercial value of the sliding door may be improved.

DETAILED DESCRIPTION

Hereinafter, an exemplary embodiment of the present disclosure will be described in detail with reference to the accompanying drawings.

Figure 1:
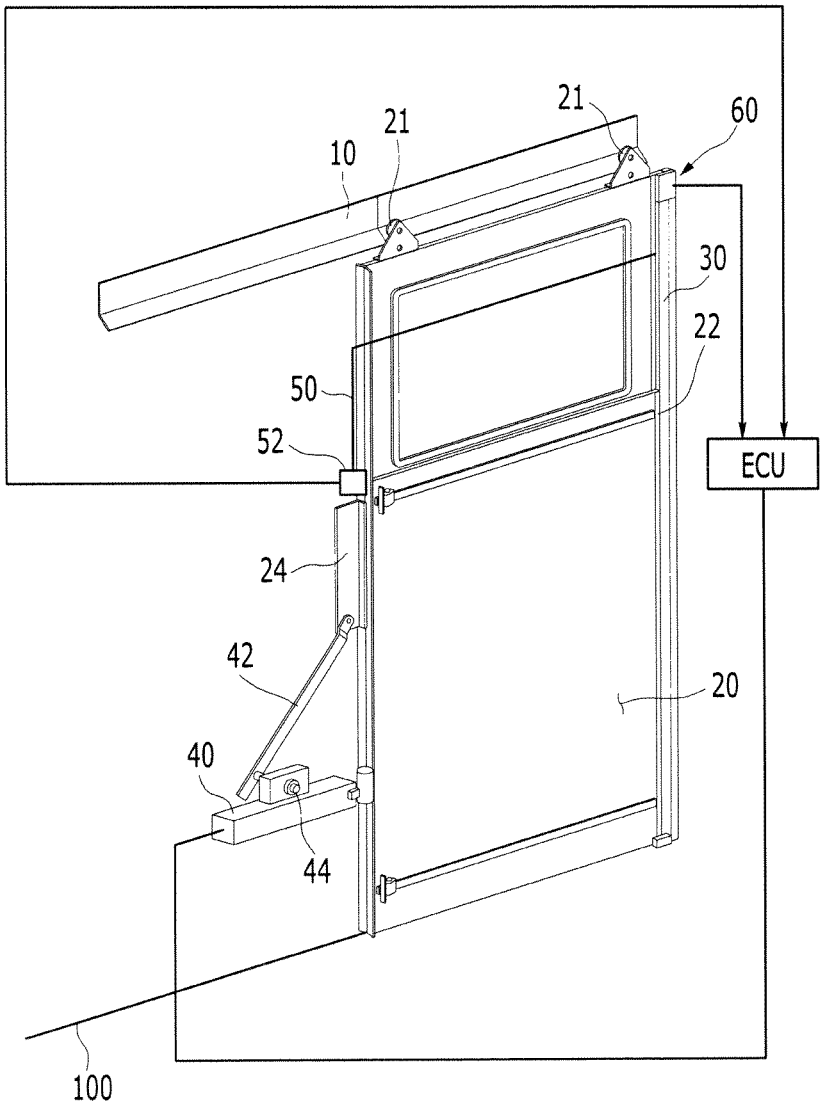
FIG. 1 is a block diagram of a sliding door device for a vehicle according to an exemplary embodiment of the present disclosure.

Referring to FIG. 1, a sliding door device for a vehicle according to an exemplary embodiment of the present disclosure includes a sliding door 20 installed to slidingly move along a guide rail 10 mounted in a vehicle body 100 to open and close a door opening formed in the vehicle body 100.

The guide rail 10 includes an L-shaped section and is extendedly installed in a longitudinal direction of a vehicle.

Two rollers 21 are mounted on the sliding door 20 so that the two rollers 21 are guided to a determined orbit and are moved along the guide rail 10 in a state of being settled in the guide rail 10.

The sliding door 20 is rectangular panel-shaped.

In FIG. 1, the sliding door 20 closes a door opening (not shown) formed in the vehicle body 100. A door weather strip 22 is attached at one edge of the sliding door 20 in a longitudinal direction of the sliding door 20. In addition, a vehicle body weather strip 30 is attached at an edge of the door opening of the vehicle body to correspond to the weather strip 22 of the sliding door 20.

The sliding door 20 is moved to close the door opening of the vehicle body and the door weather strip 22 and the vehicle body weather strip 30 are kept close to each other to maintain air-tightness. A pneumatic cylinder 40 is used as a power source for moving the sliding door 20, although other appropriate power sources than the pneumatic cylinder 40 may be used. The pneumatic cylinder 40 is connected to the sliding door 20 through an operation link 42. A guide bracket 24 into which the operation link 42 is inserted to be moved is mounted in the sliding door 20. The operation link 42 is rotatably installed around a rotating shaft 44 so that the operation link 42 receives locomotion from the pneumatic cylinder 40 when the pneumatic cylinder 40 moves toward or away from the operation link 42 and rotates around the rotating shaft 44 to push or pull the sliding door 20 and to slidingly move the sliding door 20.

In order to sense the internal pressure of the door weather strip 22, a pneumatic line 50 is connected to the door weather strip 22 and a pressure switch 52 is installed in the pneumatic line 50. When the door weather strip 22 receives an external force so that a shape and a volume of the door weather strip 22 are changed and the internal pressure of the door weather strip 22 is changed, the pressure switch 52 senses the changed internal pressure of the door weather strip through the pneumatic line 50. The pressure switch 52 is switched when the internal pressure of the door weather strip 22 is, for example, 4.5±0.5 kgf per unit area and is connected to an electronic control unit (ECU) to input a switching signal to the ECU.

When an object or an occupant is jammed between the sliding door 20 and the door opening in a process of closing the sliding door 20, the door weather strip 22 is compressed and transformed by the object or the occupant so that internal pressure of the door weather strip 22 is increased.

When the internal pressure of the door weather strip 22 is increased to no less than, for example, 4.5±0.5 kgf per unit area, the pressure switch 52 is switched to input a switching signal to the ECU and the ECU receives the switching signal of the pressure switch 52 to control an operation of the pneumatic cylinder 40 so that the sliding door 20 is operated in a direction where the door opening is opened. Therefore, it is possible to prevent the object or the occupant from being jammed in the process of closing the sliding door 20.

In certain embodiments, a sensing device 60 for sensing opening and closing of the sliding door 20 and sensing that the object or a part of the occupant's body is jammed in a point in time when the closing of the sliding door 20 is completed or in a point in time immediately before the closing of the sliding door 20 is completed is installed in an upper end of the vehicle body weather strip 30. The sensing device 60 is connected to the ECU so that a sensing signal sensed by the sensing device 60 is input to the ECU.

Figure 2:
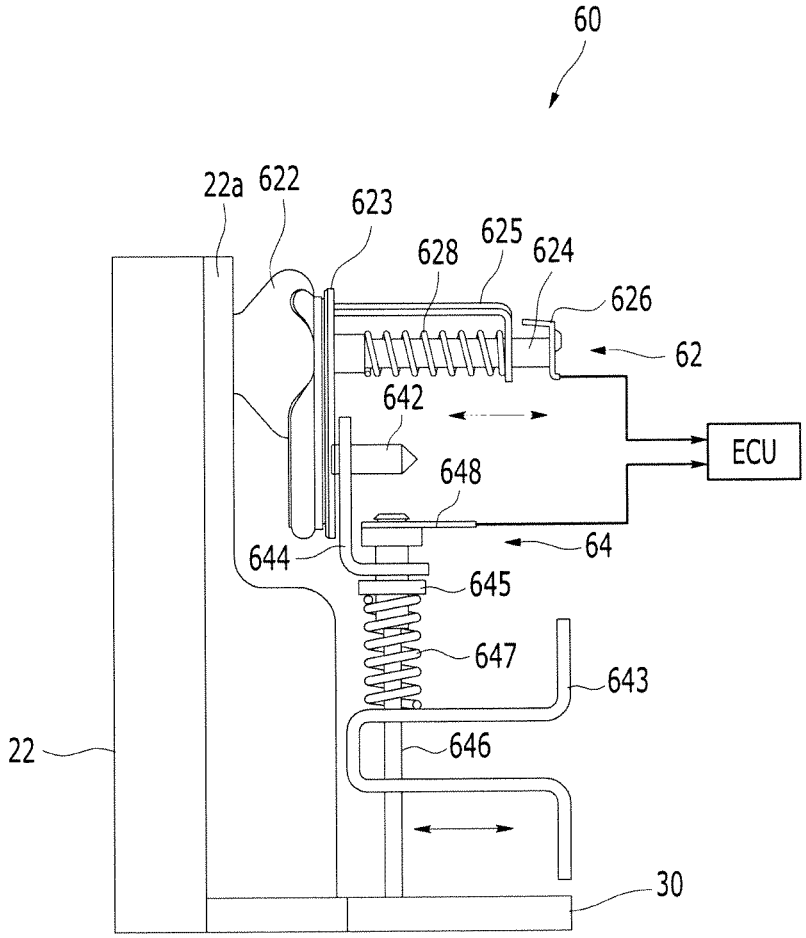
FIG. 2 is a side view of a sensing device of a sliding door device for a vehicle according to an exemplary embodiment of the present disclosure.

Referring to FIG. 2, the sensing device 60 includes a door opening and closing sensor 62 for sensing the opening and closing of the sliding door 20 and a jamming sensor 64 for sensing that the object or the occupant is jammed immediately before the sliding door 20 is closed or a point in time when the closing of the sliding door 20 is completed.

The door opening and closing sensor 62 includes an elastic contact protrusion 622 that may be elongated, a sensing rod 624 formed of a nonconductor and integrated with the elastic contact protrusion 622 to be elongated and contracted in line with elongation and contraction of the elastic contact protrusion 622, and an opening and closing sensing terminal 626 fixedly mounted at one leading end of the sensing rod 624 and connected to the ECU.

The elastic contact protrusion 622 is mounted in a mounting bracket 623 to be supported and contacts an upper end of the door weather strip 22 to be pressed as illustrated in FIG. 2 when the sliding door 20 is completely closed.

The upper end of the door weather strip 22 forms a narrow part 22*a* cut inward in a thickness direction in order to secure a space in which the elastic contact protrusion 622 is installed.

A guide bracket 625 as a conductor such as steel is fixedly attached to the mounting bracket 623 in a direction of a right angle. A through hole is formed in the guide bracket 625 and the sensing rod 624 is inserted into the through hole to be guided and moved.

A spring 628 is inserted into an external circumference of the sensing rod 624 to elastically support the sensing rod 624. One end of the spring 628 is connected to the sensing rod 624 and the other end of the spring 628 is connected to the guide bracket 625. The spring 628 is contracted when the sensing rod 624 is pressed by the elastic contact protrusion 622 to be elongated and applies an elastic restoring force to the sensing rod 624 when a pressing force of the elastic contact protrusion 622 is extinguished to restore the sensing rod 624 to an original position.

Therefore, when the sliding door 20 is closed, the door weather strip 22 presses the elastic contact protrusion 622 and the elastic contact protrusion 622 is pressed by the door weather strip 22 to press the sensing rod 624. The sensing rod 624 is pushed by the pressing force of the elastic contact protrusion 622 to be elongated, the opening and closing sensing terminal 626 mounted at the leading end of the sensing rod 624 is separated from the guide bracket 625, and the ECU determines whether the closing of a door is completed by a separation state of the opening and closing sensing terminal 626.

Figure 3:
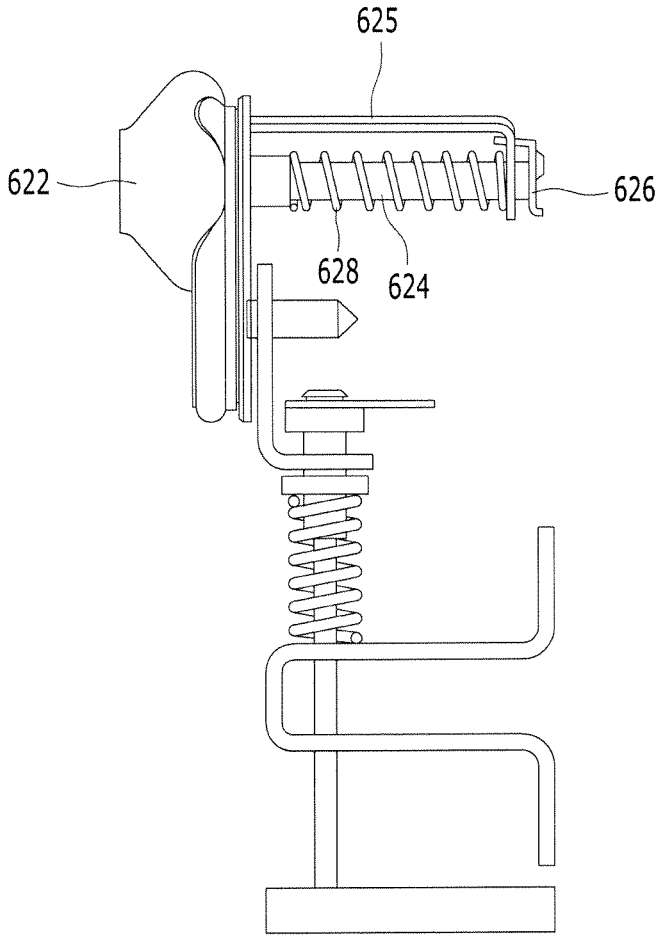
FIG. 3 is a view illustrating an operation in a state where a door of a sensing device of a sliding door device for a vehicle according to an exemplary embodiment of the present disclosure is opened and an object or an occupant is not jammed.

When the sliding door 20 is opened, the door weather strip 22 is moved with the sliding door 20 to be separated from the elastic contact protrusion 622 so that the elastic contact protrusion 622 is restored to an original shape by an elastic restoring force thereof as illustrated in FIG. 3.

When the elastic contact protrusion 622 is restored, pressure applied to the sensing rod 624 is extinguished so that the sensing rod 624 receives the elastic restoring force of the spring 628 to be contracted and the opening and closing sensing terminal 626 installed in the sensing rod 624 is connected to the guide bracket 625. The ECU determines whether the sliding door is opened by the medium of a connection state between the opening and closing sensing terminal 626 and the guide bracket 625.

The jam sensor 64 is installed in the mounting bracket 623 to protrude and includes a fixing pin 642 ground connected to a vehicle body. The fixing pin is inserted into a ground bracket 644 formed of a steel material as a conductor. The ground bracket 644 is L-shaped and one side of which is fixed to the fixing pin 642. One end of a sensing wire 646 is penetratingly inserted into the other side of the ground bracket 644, a jam sensing terminal 648 is installed at one end of the sensing wire 646, and the jam sensing terminal 648 is connected to the ECU. The sensing wire 646 is inserted into a U-shaped supporting bracket 643 in a longitudinal direction and the supporting bracket 643 is fixedly mounted in an appropriate part of the vehicle body. The sensing wire 646 is inserted to penetrate both side surfaces of the U-shaped supporting bracket 643 that face each other, and the supporting bracket 643 supports the sensing wire 646 inserted into the supporting bracket 643.

A stopper 645 as a nonconductor is formed at one end of the sensing wire 646 and extends in a diameter direction at a predetermined interval from the jam sensing terminal 648 in a longitudinal direction of the sensing wire.

The other side of the ground bracket 644 is inserted between the stopper 645 and the jam sensing terminal 648. An elastic spring 647 is inserted between the stopper 645 and the supporting bracket 643 to be inserted into an external circumference of the sensing wire 646. The elastic spring 647 elastically supports the sensing wire 646, is contracted when the sensing wire 646 receives an external force to be elongated, and applies an elastic restoring force to the sensing wire 646 when the external force is extinguished to promote restoration of the sensing wire 646.

Figure 4:
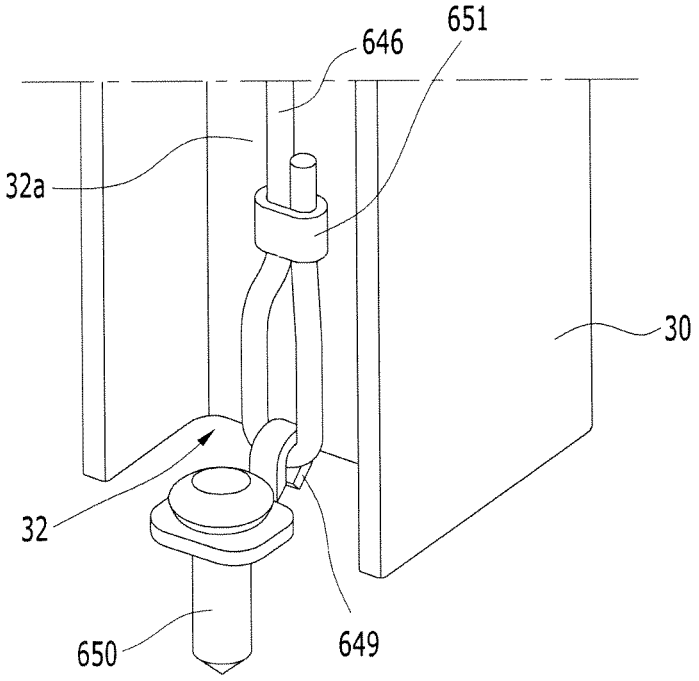
FIG. 4 is a perspective view of a lower end of a sensing wire of a sliding door device for a vehicle according to an exemplary embodiment of the present disclosure.

Referring to FIG. 4, a lower end of the sensing wire 646 is curved to be U-shaped and is fixed by a clip 651, a hook 649 is hooked at the lower end of the sensing wire 646, and the hook 649 is fixed to an appropriate part of the vehicle body by the medium of a fixing bolt 650.

An accommodating groove 32 grooved in a thickness direction of the vehicle body weather strip 30 is extendedly formed in the vehicle body weather strip 30 in a longitudinal direction and the sensing wire 646 is accommodated in the accommodating groove 32.

The sensing wire 646 is installed to be separated from a bottom surface 32*a* of the accommodating groove 32 and is pressed toward the bottom surface 32*a* of the accommodating groove 32 so that an entire length of the sensing wire 646 may be elongated.

FIG. 2 illustrates an operation in a case where the occupant or the object is not jammed in the sliding door in a state where the sliding door 20 is closed. When it is determined by the ECU that the sliding door is completely closed in a state where the occupant or the object is not jammed in the sliding door by the medium of the door opening and closing sensor 62 and the jam sensor 64, fuel is supplied to an engine so that a vehicle may be driven.

FIG. 3 illustrates that the sliding door 20 is opened in a state where the occupant or the object is not jammed. When the ECU senses that the sliding door 20 is opened by the medium of the door opening and closing sensor 62, supply of fuel to the engine is blocked so that a state in which a vehicle is stopped may be maintained.

On the other hand, the ECU determines whether the object or the occupant is jammed in the process of closing the sliding door 20 by the medium of the pressure switch 52. However, in a predetermined range immediately before the sliding door 20 is completely closed, for example, in a range of 30 mm immediately before the sliding door 20 is completely closed, the ECU ignores the sensing signal of the pressure switch 52 and determines whether the object or the occupant is jammed through the jam preventing sensor 64.

Figure 5:
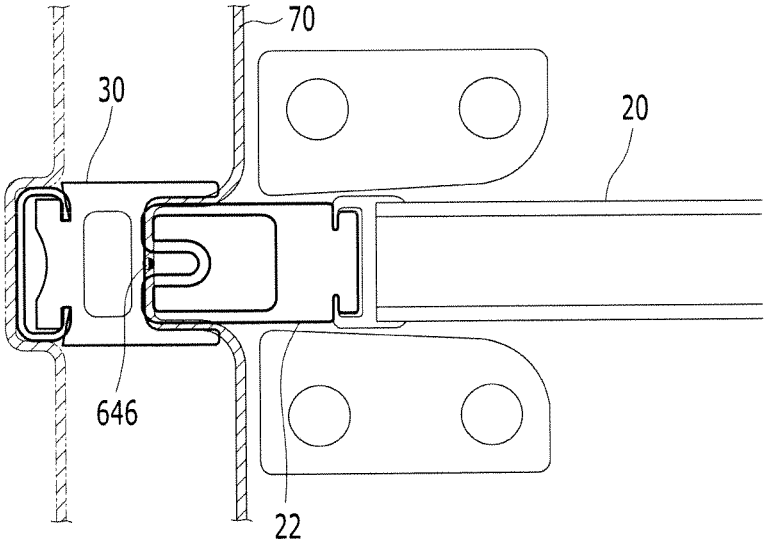
FIG. 5 is a cross-sectional view of a state in which a door of a sensing device of a sliding door device for a vehicle according to an exemplary embodiment of the present disclosure is closed and an object or an occupant is jammed.
Figure 6:
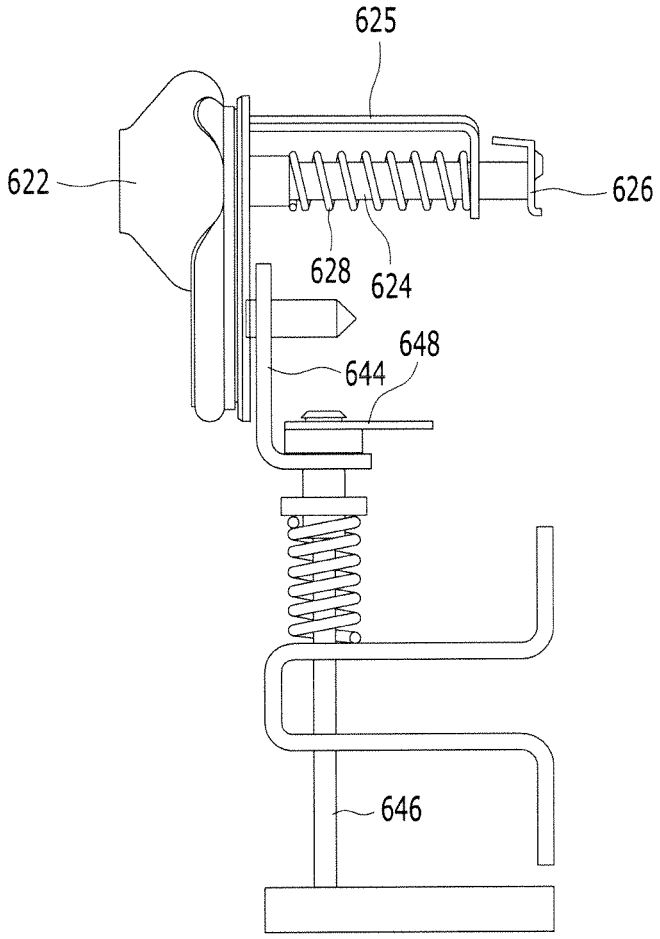
FIG. 6 is a view illustrating an operation in a state where a door of a sensing device of a sliding door device for a vehicle according to an exemplary embodiment of the present disclosure is closed and an object or an occupant is jammed.

That is, when the sliding door 20 is closed in the range of 30 mm in a state where an object 70 such as clothes or a shoulder strap of an occupant is jammed, as illustrated in FIG. 5, the sensing wire 646 is pressed by the object 70 and elongated. When the sensing wire 646 is elongated, the jam sensing terminal 648 contacts the ground bracket 644 and the ECU determines whether the object or the occupant is jammed through the jam sensing terminal 648.

When the ECU determines that the object or the occupant is jammed, first, supply of fuel to the engine is blocked so that a state in which a vehicle is stopped is maintained and safety of the occupant may be secured. Then, the sliding door 20 is operated in a direction where the sliding door 20 is opened so that the jammed object or occupant may be pulled out.

While this disclosure has been described in connection with what is presently considered to be practical exemplary embodiments, it is to be understood that the disclosure is not limited to the disclosed embodiments, but, on the contrary, is intended to cover various modifications and equivalent arrangements included within the spirit and scope of the appended claims.

What is claimed is:

1. A sliding door device for a vehicle, comprising:

a sliding door installed in a vehicle body to be slidingly moved to open and close a door opening formed in the vehicle body;

a vehicle body weather strip attached to the door opening;

a sensing device installed in the vehicle body weather strip to sense that an object or an occupant is jammed in a state before the sliding door is completely closed when the sliding door is closing, wherein the sensing device comprises:

a door opening and closing sensor for sensing opening or closing of the sliding door; and a jam sensor for sensing that the object or the occupant is jammed in a state where the sliding door is closed;

an electronic control unit (ECU) for receiving a sensing signal of the sensing device to control opening and closing of the sliding door, wherein the sliding door comprises a door weather strip attached to the vehicle body weather strip to seal the door opening, and wherein the door opening and closing sensor comprises:

an elastic contact protrusion pressed by the door weather strip in a state where the sliding door is closed and restored to an original shape when the elastic contact protrusion is separated from the sliding door;

a sensing rod integrated with the elastic contact protrusion to be elongated and contracted in line with elongation and contraction of the elastic contact protrusion;

an opening and closing sensing terminal fixedly mounted at one leading end of the sensing rod and connected to the ECU; and a spring inserted into an external circumference of the sensing rod to elastically support the sensing rod.

2. The sliding door device of claim 1, wherein the elastic contact protrusion is mounted in and supported by a mounting bracket, and wherein a narrow part is formed in an upper end of the door weather strip and cut inward in a thickness direction.

3. The sliding door device for a vehicle of claim 2, wherein a guide bracket is fixedly attached to the mounting bracket at a right angle joint, and wherein a through hole is formed in the guide bracket so that the sensing rod is inserted into the through hole to be guided and moved.

4. The sliding door device for a vehicle of claim 2, wherein the jam sensor comprises:

a protruding fixing pin installed in the mounting bracket and connected to ground to the vehicle body;

a ground bracket, wherein the fixing pin is inserted into one side of the ground bracket;

a sensing wire having one end movably inserted into an other side of the ground bracket and an other end of the sensing wire extendedly fixed in a longitudinal direction of the vehicle body weather strip;

a jam sensing terminal installed at one end of the sensing wire and connected to the ECU; and a spring for elastically supporting the sensing wire.

5. The sliding door device for a vehicle of claim 4, wherein the sensing wire is inserted into a U-shaped supporting bracket in a longitudinal direction and fixedly mounted in the vehicle body, wherein a stopper is provided at one end of the sensing wire, and wherein the spring is installed between the stopper and the supporting bracket.

6. The sliding door device for a vehicle of claim 5, wherein the sensing wire penetrates both side surfaces of the U-shaped supporting bracket that face each other.

7. The sliding door device for a vehicle of claim 4, wherein the other end of the ground bracket is arranged between one end of the sensing wire and the stopper.

8. The sliding door device for a vehicle of claim 4, wherein the other end of the sensing wire is U-shaped and fixed by a clip, wherein a hook is hooked at the other end of the sensing wire, and wherein the hook is fixed to the vehicle body by a fixing bolt.

9. The sliding door device of claim 4, wherein an accommodating groove having a bottom surface grooved in a thickness direction is extendedly formed in the vehicle body weather strip in a longitudinal direction, and wherein the sensing wire is accommodated in the accommodating groove and separated from the bottom surface.

10. The sliding door device of claim 1, wherein a pressure switch for sensing internal pressure of the door weather strip is connected to the door weather strip through a pneumatic line, and wherein the ECU senses a change in the internal pressure of the door weather strip through the pressure switch and controls the sliding door to open when the internal pressure is not less than predetermined pressure.

11. The sliding door device of claim 1, further comprising:

a pneumatic cylinder as a power source for moving the sliding door; and an operation link for connecting the pneumatic cylinder and the sliding door to each other so that an operating force of the pneumatic cylinder is transmitted to the sliding door.

* * * * *